US005288132A

United States Patent [19]

Vaughn

[11] Patent Number: 5,288,132

[45] Date of Patent: Feb. 22, 1994

[54] PORTABLE SEAT CUSHION

[76] Inventor: Jay E. Vaughn, 3004 Furman La., Alexandria, Va. 22306

[21] Appl. No.: 10,382

[22] Filed: Jan. 28, 1993

[51] Int. Cl.[5] ..... A47C 7/62; A47C 27/15

[52] U.S. Cl. ..... 297/452.22; 5/653; 297/452.32

[58] Field of Search ..... 5/653, 654, 454, 481, 5/448; 297/458, 459, 453, DIG. 1, 452.22, 452.32

[56] References Cited

U.S. PATENT DOCUMENTS

| | | | |
|---|---|---|---|
| D. 182,647 | 4/1958 | Cox . | |
| D. 281,210 | 11/1985 | Roberts | D6/601 |
| D. 294,900 | 3/1988 | Willingham | D6/601 |
| D. 310,608 | 9/1990 | Axell | D6/601 |
| 779,851 | 1/1905 | Holtzman | 297/452.22 |
| 1,742,186 | 1/1930 | Claus | 5/653 |
| 2,384,713 | 9/1945 | Varma | 297/458 |
| 2,483,222 | 9/1949 | Moss | 5/448 |
| 2,552,476 | 5/1951 | Barton | 297/452.22 |
| 2,734,556 | 2/1956 | Hebrank | 297/DIG. 1 |
| 3,279,849 | 10/1966 | Radke . | |
| 3,942,652 | 6/1960 | Chapman | 297/452.22 |
| 3,987,507 | 10/1976 | Hall | 5/653 |
| 4,522,447 | 6/1985 | Snyder et al. | 5/653 |

*Primary Examiner*—Alexander Grosz

*Attorney, Agent, or Firm*—Shlesinger, Arkwright & Garvey

[57] ABSTRACT

A portable seat cushion having upper and lower seat pads. The upper seat pad is hingedly connected to the lower seat pad forming a hingeline therebetween. The lower seat pad includes first and second cushion members. The first cushion member includes top, bottom and side surfaces. The second cushion member is secured to the bottom surface of the first cushion member. A cavity is formed in the second cushion member such that when an individual sits on the lower seat pad a portion of the first cushion member is free to recess or sag into the first cavity. The upper seat pad includes a lower back support positioned adjacent the hingeline formed between the upper and lower seat pads. The seat cushion is formed from high density polyurethane.

15 Claims, 2 Drawing Sheets

PORTABLE SEAT CUSHION

FIELD OF THE INVENTION

The present invention is directed to devices for padding or cushioning the seats of stadiums, cars, taxis, buses, trucks, boats, and the like for the primary purpose of curing and reducing hemorrhoidal pains as well as reducing and eliminating back discomfort.

BACKGROUND OF THE INVENTION

Individuals often experience discomfort when sitting in one place for a prolonged periods of time. For instance, those people whose livelihood involves daily sitting for long periods in a vehicle such as a taxi, car, bus, truck, boat or airplane will often develop hemorrhoids and experience severe discomfort in the lower back and buttocks. People with hemorrhoidal problems can also experience discomfort while watching a ball game or similar event at a stadium.

A number of padding or cushioning devices have been developed in an effort to reduce back and hemorrhoidal pain brought about by sitting for a lengthy period of time. However, these devices have had little success as compared to the present invention.

OBJECTS AND SUMMARY OF THE INVENTION

An object of the present invention is to provide a seat cushion which significantly reduces an individual's discomfort when sitting for prolonged periods of time and tends to heal and substantially reduce hemorrhoidal swelling.

Another object of the present invention is to provide a seat cushion formed from high density polyurethane which is flexible to conform to the contour of a seat.

A further object of the present invention is to provide a portable seat cushion that can be readily placed on or removed from a seat.

Yet another object of the present invention is to provide a seat cushion which supports and conforms to an individual's lower back (lumbar).

Still a further object of the present invention is to provide a seat cushion which can be readily folded and stored underneath a seat when not in use.

Yet still another object of the present invention is to provide a seat cushion which pads or protects both an individual's back and buttocks.

Still another object of the present invention is to provide a seat cushion which significantly reduces the pressure exerted about an individual's anus thereby preventing hemorrhoids from developing or curing those already developed.

In summary, the present invention is directed to a portable seat cushion having upper and lower seat pads. The upper seat pad is hingedly connected to the lower seat pad forming a hingeline therebetween. The lower seat pad includes first and second cushion members. The first cushion member includes top, bottom and side surfaces. The second cushion member is secured to the bottom surface of the first cushion member. A cavity is formed in the second cushion member such that when an individual sits on the lower seat pad a portion of the first cushion member is free to recess into the first cavity. The upper seat pad includes a lower back support positioned adjacent the hingeline formed between the upper and lower seat pads. The seat cushion is formed from high density polyurethane.

It will be understood that the above objects and advantages of the invention are not an exhaustive listing but merely illustrative of several desirable aspects of the present invention. Further, objects and advantages of the present invention will become apparent upon a review of the instant specification and the accompanying drawings.

DETAILED DESCRIPTION OF THE DRAWINGS

DETAILED DESCRIPTION OF THE PREFERRED EMBODIMENT OF THE PRESENT INVENTION

The preferred embodiments will now be described with reference to the accompanying drawings.

FIGS. 1 TO 5

Figure 1:
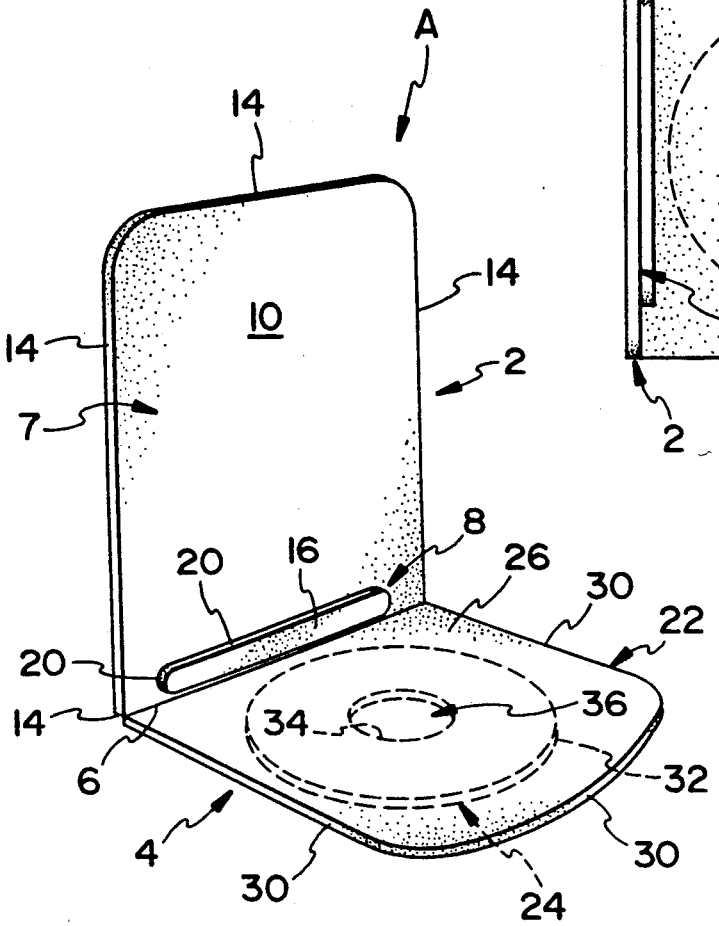
FIG. 1 is a perspective view of a preferred embodiment of the present invention.

Referring to FIG. 1, a seat cushion A includes an upper seat pad 2 and a lower seat pad 4. The upper seat pad 2 is hingedly connected at its lower edge to lower seat pad 4 thereby forming hingeline 6.

Figure 2:
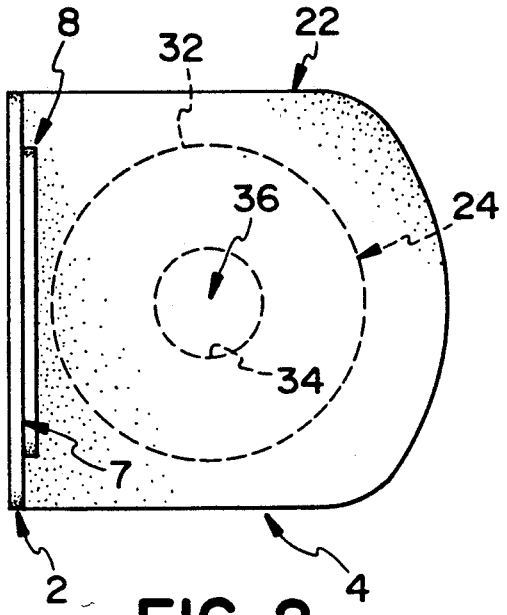
FIG. 2 is a plan view of the embodiment illustrated in FIG. 1.

The upper seat pad 2 includes a cushion member 7 and a lower back support member 8. The cushion member 7 includes front, rear and side surfaces 10, 12 and 14, respectively. Preferably, cushion member 7 has a thickness of between approximately ½" to 1". The front and rear surfaces 10 and 12 are preferably substantially continuous and planar. The lower back support member 8 includes front, rear and side surfaces 16, 18 and 20, respectively. As is seen in FIGS. 1 and 2, the lower back support member 8 extends substantially parallel to and is disposed adjacent hingeline 6. Preferably, the lower back support member is approximately 1" thick, i.e. the front surface 16 of member 8 is offset outwardly approximately 1" inch from the front surface 10 of member 2.

Lower seat pad 4 includes first and second cushion members or pads 22 and 24, respectively. Preferably, the pads 22 and 24 have a thickness between approximately ½" to 1". The first pad 22 includes top, bottom, and side surfaces 26, 28 and 30, respectively. Top and bottom surfaces 26 and 28 are preferably substantially continuous and planar. As is seen in FIGS. 1 and 2, the second pad 24 is donut shaped. More specifically, the outer and inner perimeters 32 and 34, respectively, of pad 24 are circular in shape. It will be appreciated that second pad 24 may be configured differently.

Figure 3:
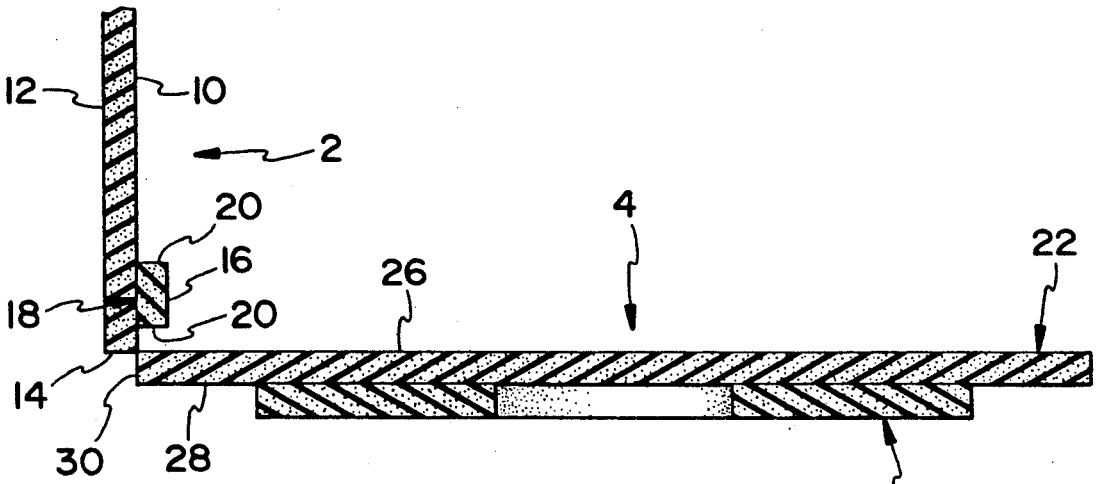
FIG. 3 is a fragmentary cross-sectional view of the embodiment illustrated in FIG. 1.
Figure 4:
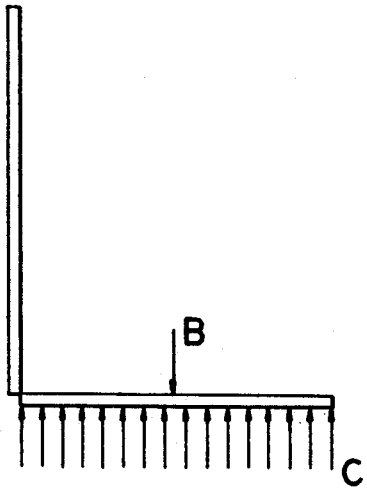
FIG. 4 is a side elevational view of a force diagram of a conventional seat.
Figure 5:
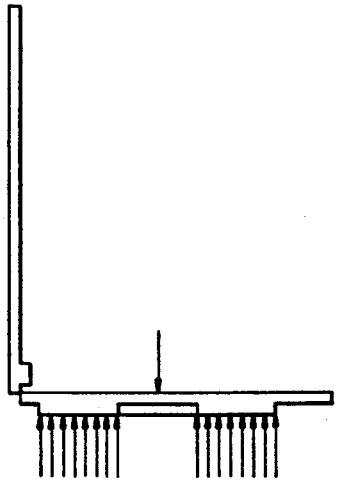
FIG. 5 is a side elevational view of a force diagram of the embodiment illustrated in FIG. 1.

Opening 36 in pad 24 extends from top surface 38 to bottom surface 40. Preferably, opening 36 is formed approximately in the center of pad 24 and is circular in shape. However, it will be readily appreciated that the position and configuration of opening 36 may be varied. As is seen in FIG. 3, opening 36 permits that portion of pad 22 adjacent thereto to sag or recess, thereby eliminating upward forces around the individual's anus. This is readily seen when referring to the force diagrams in FIGS. 4 and 5. FIG. 4 is a force diagram of the forces exerted when a person sits on a conventional chair. As is seen by arrow B, the weight of the individual exerts a downward force. The seat on the other hand exerts a corresponding upward force indicated by arrows C. The upward force, as indicated by arrows C, is evenly distributed about the entire back side of the individual. The force diagram of the present invention is illustrated in FIG. 5. The primary difference being that no upward force is exerted by the seat in the area of opening 36. Opening 36 is positioned such that it is directly below an individual's anus. Thus, no force is exerted about this region thereby significantly improving the comfort of the individual.

Preferably, the seat cushion A is formed from a high density foam material such as polyurethane. It is desirable that the compression factor of the material be between 25 to 55 lbs./cu. ft. A compression factor of 45 lbs./cu. ft. is most desirable. The material may have a density of 1.8 lbs./cu. ft. but it will be understood that the material may have other densities. Forming the seat cushion A from high density polyurethane, permits the same to bend to form to the contours of the seat but is sufficiently rigid to prevent cushion 24 from being compressed to such an extent that upward forces are exerted on the individual in the region resting directly above opening 36.

Figure 6:
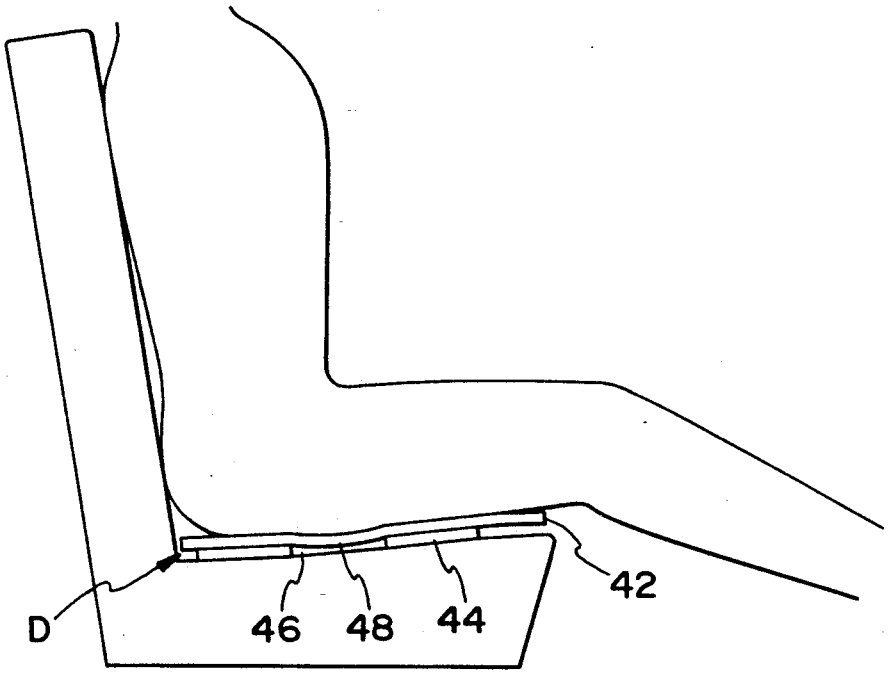
FIG. 6 is a side elevational view of a second embodiment of the present invention.
Figure 7:
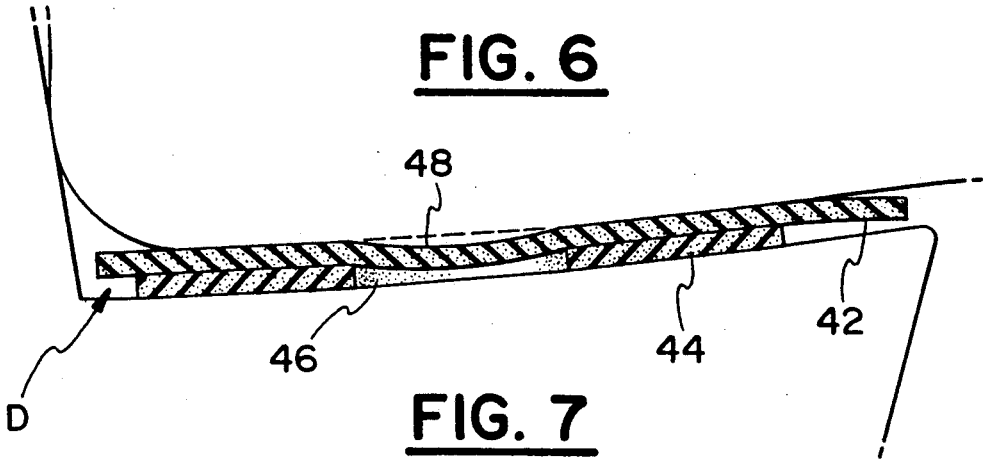
FIG. 7 is a fragmentary cross-sectional view of the embodiment illustrated in FIG. 6.

A second embodiment of the present invention will now be described with reference to FIGS. 6 and 7. A seat cushion D is identical to the seat cushion A with the sole exception that upper seat pad 2 is omitted. The seat cushion D includes first and second pads 42 and 44, respectively. Seat cushion D includes an opening 46 similar to opening 36. As is seen in FIGS. 6 and 7, opening 46 permits the portion 48 of the pad 42 to sag or recess therein. Thus, no or little upward force is exerted on the region directly above opening 46.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

I claim:

1. An apparatus for cushioning seats, comprising:

a) a lower seat pad, said lower seat pad being formed from a flexible material such that said lower seat pad conforms generally to the contour of a seat;

b) said lower seat pad includes first and second cushion members, said first cushion member being positioned above said second cushion member;

c) said first cushion member having a top surface, a bottom surface and side surfaces, said top and bottom surfaces extending between said side surfaces;

d) said second cushion member being secured to said bottom surface of said first cushion member, said second cushion member having only a single cavity formed therein, said cavity being substantially circular in shape;

e) at least a portion of said bottom surface of said first cushion member being disposed directly above said cavity, said portion of said bottom surface being removed from said cavity when said lower seat pad is not in use and said portion of said bottom surface being free to recess in said cavity upon an individual sitting on said lower seat pad.

2. An apparatus as in claim 1, wherein:

a) said second cushion member is positioned inwardly of said side surfaces of said first cushion member.

3. An apparatus as in claim 1, wherein:

a) said cavity is formed generally in the center of said second cushion member.

4. An apparatus as in claim 1, further including:

a) an upper seat pad hingedly connected to said lower seat pad.

5. An apparatus as in claim 4, wherein:

a) said upper seat pad includes means for supporting an individual's lower back.

6. An apparatus for cushioning seats, comprising:

a) a lower seat pad and an upper seat pad, said lower seat pad being hingedly connected to said upper seat pad forming a hingeline therebetween;

b) said upper seat pad having front, rear and side surfaces; and, c) said upper and lower seat pads being formed from a flexible material such that said upper and lower seat pads conform generally to the contour of a seat, said lower seat pad including only a single substantially circular shaped cavity, said cavity being free form any of said material when said lower seat pad is not in use, said cavity receiving a portion of said lower seat pad upon an individual sitting thereon.

7. An apparatus as in claim 6, wherein:

a) said front surface of said upper seat pad is substantially planar.

8. An apparatus as in claim 6, wherein:

a) said lower seat pad includes a donut shaped cushion member.

9. An apparatus as in claim 6, wherein:

a) said upper and lower seat pads are formed from high density polyurethane.

10. An apparatus as in claim 6, wherein:

a) said lower seat pad includes first and second cushion members, said first cushion member being positioned above said second member.

11. An apparatus as in claim 10, wherein:

a) said cavity is formed in said second cushion member.

12. An apparatus as in claim 10, wherein:

a) said second cushion member is substantially donut shaped.

13. An apparatus for cushioning seats, comprising:

a) upper and lower seat pads, said upper seat pad being hingedly connected to said lower seat pad forming a hingeline therebetween;

b) said lower seat pad including first and second cushion members, said first cushion member being positioned above said second cushion member;

c) said first cushion member having a top surface, a bottom surface and side surfaces, said top and bottom surfaces being continuous and extending between said side surfaces;

d) said second cushion member being secured to said bottom surface of said first cushion member, said second cushion member having a cavity formed therein whereby upon an individual sitting on said lower seat pad a portion of said first cushion member is free to recess in said cavity of said second cushion member;

e) said upper seat pad includes a first member having front, rear and side surfaces, said upper seat pad further including a back support member having front, rear and side surfaces, said rear surface of said back support member being secured to said front surface of said first member.

f) said second cushion member being substantially donut shaped and positioned inwardly of said side surfaces of said first cushion member; and g) said back support pad being positioned adjacent said hingeline.

14. An apparatus as in claim 13, wherein:

a) said cavity is substantially circular in shape.

15. An apparatus as in claim 13, wherein:

a) said second cushion member includes top and bottom surfaces, said cavity extends from said top surface to said bottom surface.

* * * * *